US005271033A

United States Patent [19]

Bethge et al.

[11] Patent Number: 5,271,033

[45] Date of Patent: Dec. 14, 1993

[54] INDUCTION FURNACE FOR MELTING AND CASTING SUBSTANCES IN A NONREACTIVE ATMOSPHERE

[75] Inventors: Daniel Bethge; Alfred Henn, both of Rodenbach; Michael Schaefer, Altenstadt; Hans-Johann Kemmer, Rödermark; Otto Stenzel, Gründau, all of Fed. Rep. of Germany

[73] Assignee: Leybold Durferrit GmbH, Cologne, Fed. Rep. of Germany

[21] Appl. No.: 928,913

[22] Filed: Aug. 11, 1992

[30] Foreign Application Priority Data

Mar. 13, 1992 [DE] Fed. Rep. of Germany ..... 4208061

[51] Int. Cl.[5] ..... F27D 3/00

[52] U.S. Cl. ..... 373/143; 373/138; 373/140; 373/156

[58] Field of Search ..... 373/143, 138, 140, 141, 373/147, 48, 153, 152, 154, 156, 59, 163, 159, 142; 219/10.491; 439/196; 361/379, 385; 164/336, 513; 174/15.7; 266/143, 148, 240

[56] References Cited

U.S. PATENT DOCUMENTS

| | | | |
|---|---|---|---|
| 1,884,637 | 10/1932 | Feehan | 373/143 |
| 2,166,734 | 7/1939 | Strube et al. | 373/159 |
| 2,504,840 | 4/1950 | Johnson | 373/143 |
| 2,520,598 | 8/1950 | Harter et al. | 373/143 |
| 2,587,727 | 3/1952 | Horswell et al. | 373/163 |
| 2,629,756 | 2/1953 | Wilkins et al. | 373/59 |
| 2,675,414 | 4/1954 | Capita | 373/154 |
| 2,785,214 | 3/1957 | Segsworth | 373/153 |
| 2,890,258 | 6/1959 | Krall et al. | 373/147 |
| 3,311,695 | 3/1967 | Kasper | 373/153 |
| 3,790,338 | 2/1974 | Duca | 432/247 |
| 4,331,828 | 5/1982 | Schlienger | 373/153 |
| 5,125,004 | 6/1992 | Roberts et al. | 373/143 |

*Primary Examiner*—Bruce A. Reynolds
*Assistant Examiner*—Tu Hoang
*Attorney, Agent, or Firm*—Felfe & Lynch

[57] ABSTRACT

A furnace chamber contains a chassis to which a closure plate for said chamber is removably fixed. A tilting frame is borne by said chassis in a pair of coaxial tilting bearings, one of which incorporates a rotary lead through for power lines and cooling lines to an induction coil surrounding a crucible on the tilting frame. The chassis includes a pair of rails which are movable horizontally on wheels mounted to the floor of the furnace chamber.

10 Claims, 5 Drawing Sheets

INDUCTION FURNACE FOR MELTING AND CASTING SUBSTANCES IN A NONREACTIVE ATMOSPHERE

BACKGROUND OF THE INVENTION

The invention relates to an induction furnace for melting and casting substances in a nonreactive atmosphere, having a vacuum-tight furnace chamber with an opening and a closure plate associated therewith, behind which there is disposed a tiltable crucible which has a pouring spout and is surrounded by at least one induction coil, and in which there is also a rotary lead-through carrying current feeders and coolant tubes for the induction coil.

In an induction furnace of this kind, disclosed in U.S. Pat. No. 4,331,828, rotary lead-through is situated in a swinging furnace door and it carries on a unilateral or cantilevered bearing both the melting crucible and the induction coil surrounding the latter. The door is thus subjected to additional stress by twisting forces which have an adverse influence on the sealing of the door against the furnace chamber. Furthermore, the rotary lead-through, which in the final analysis is the single support for the crucible and the induction coil, is also subject to tilting forces which endanger the seal which is extremely necessary at this location. The known furnace is consequently suitable only for melting relatively small amounts of material, and the use of sliding contacts for feeding the coil current leads to the same conclusion. Only the coolant water feeding is performed through hoses and a hose drum which in turn is joined to rigid pipes which are brought through the rotary lead-through. The known arrangement is therefore suitable only for supplying a no more than two-part induction coil. Also, the couplings for the water and power lines to the induction coil are inside of the furnace chamber, so that any leakage during vacuum operation results in serious disturbances of operation.

The task of producing a nonreactive atmosphere in such an induction furnace includes vacuum operation, operation under shielding gas at standard pressure, and under protective gas at a subatmospheric pressure.

SUMMARY OF THE INVENTION

The invention is addressed to the problem of improving such an induction furnace to make it suitable for melting and casting charges of metal weighing from 500 kg to the ton range.

The closure plate is arranged on a chassis which can roll linearly on wheels and on which a tilter is mounted by means of two coaxial tilting bearings situated one on each side of the pouring spout.

In a construction of this kind, first of all the closure plate is not at all stressed by twisting forces, so that the frame-like seal between the closure plate and the furnace chamber remains at least largely unaffected by the charge weight.

The bilateral mounting of the crucible and induction coil furthermore relieves the rotary lead-through of any other flexural stress that might occur, so that the ease of movement of the turning or swinging movement and the gaskets also remain at least largely unaffected by the charge weight. Lastly, the arrangement of the tilting bearings on both sides of the pouring spout makes it possible for the center of rotation to be located at least in the immediate vicinity of the lip of the casting spout, thus permitting a much more controlled pouring than in the state of the art in which the axis of rotation or tilting axis runs approximately through the center of the crucible axis.

It is especially advantageous if the rotary lead-through is one of the two tilting bearings.

In an advantageous embodiment the rotary lead-through is provided with a hollow cylindrical internal bearing body which is closed at its end facing the crucible with a plate of insulating material with a plug inserted in it for leading the feeders to the induction coil, and bears on its outside end a sprocket for engagement by a tilting drive.

In this manner the stress on the rotary lead-through is distributed over the length of the bearing body. Furthermore, this forms a cylindrical cavity under atmospheric pressure within the lead-through, in which the releasable water-tight screw connections in the lines leading to the induction coil can be contained. The water-tight screw connections can consequently be released without impairing the vacuum or the shielding gas atmosphere in the furnace chamber.

Furthermore, to permit the crucible to be shifted out of the furnace chamber without having to put up with any unstable guidance, the wheels on which the chassis is supported can be fastened stationarily on the floor of the furnace chamber, and the closure plate of the furnace chamber can have on its outer side at its bottom edge supporting wheels which can run on rails.

DETAILED DESCRIPTION OF THE PREFERRED EMBODIMENT

Figure 1:
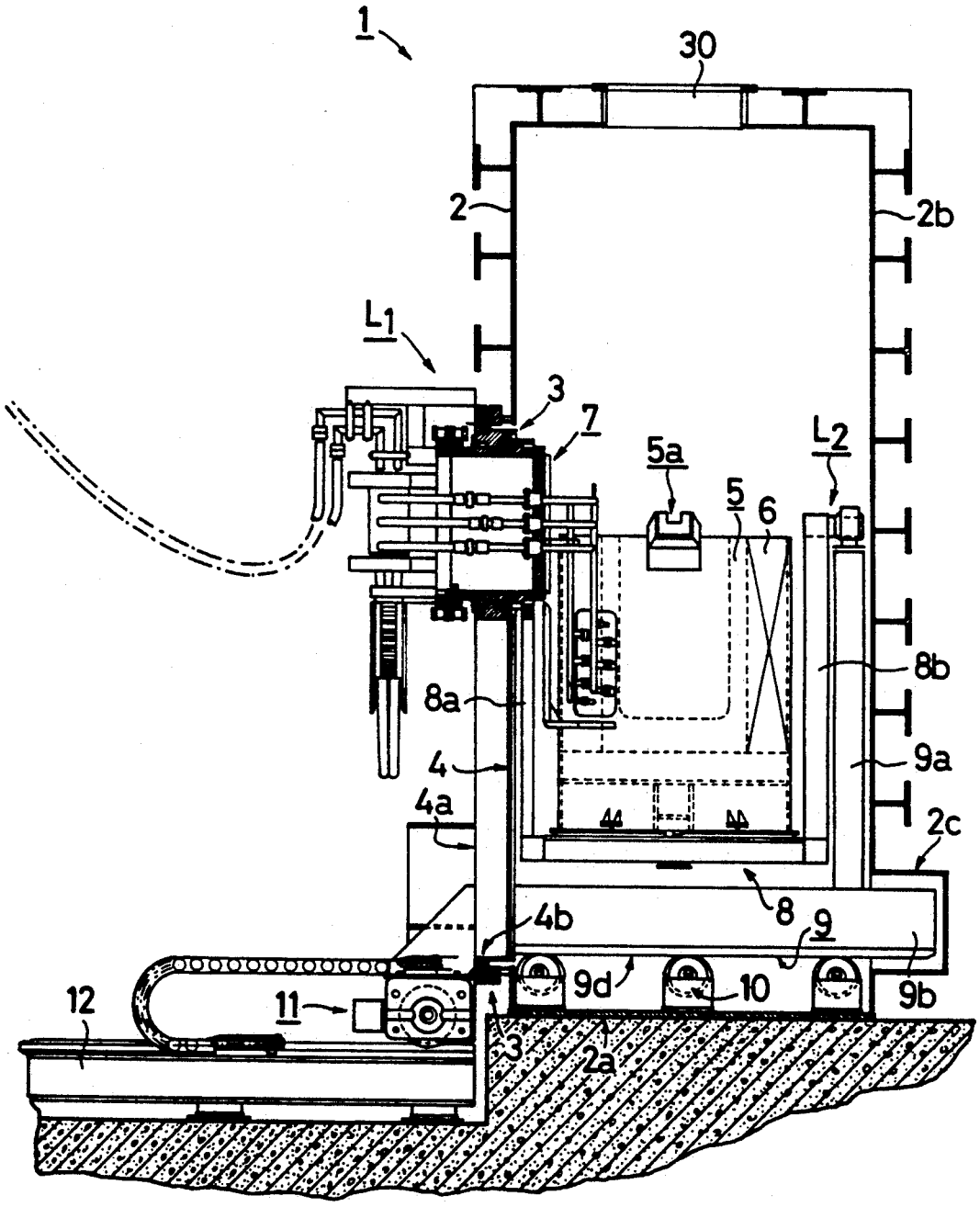
FIG. 1 is a vertical section through the induction furnace at the rotary lead-through, FIG. 2 shows the rotary lead-through of FIG. 1 on a larger scale.

In FIG. 1 is shown an induction furnace 1 which is typically designed for the melting and casting of metals. This induction furnace has a vacuum-tight furnace chamber 2 with a rectangular opening 3 which in the working position represented is sealed vacuum-tight by a closure plate 4. Behind this closure plate is a crucible 5 which is surrounded by an induction coil 6. This crucible 5 has a pouring spout **5*a* with a lip 5*b* (FIG. 2**).

Figure 2:
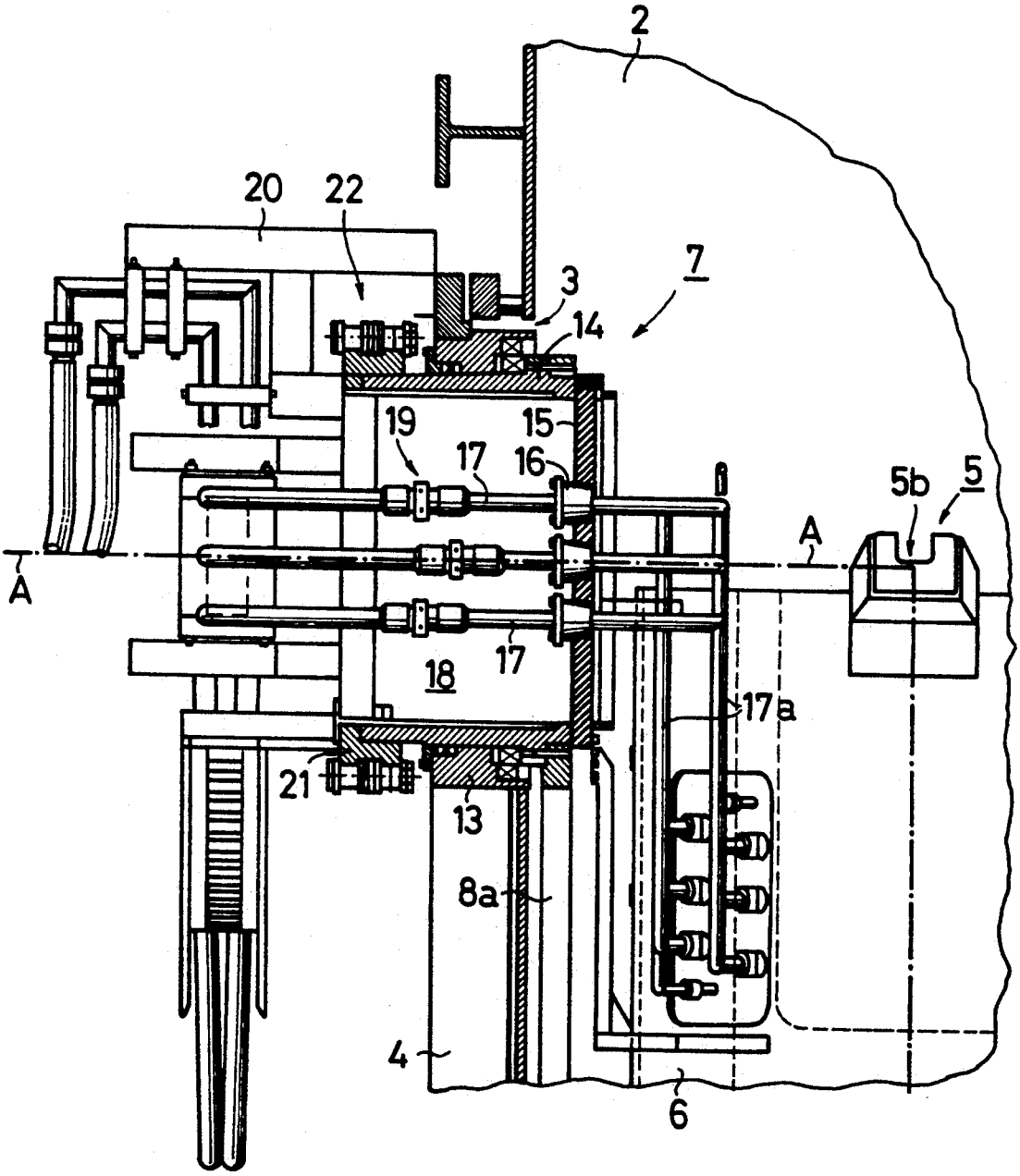

In the door 4 there is a rotary lead-through 7 which will be further explained with the aid of FIG. 2. This rotary lead-through is rotationally symmetrical with the tilting axis A—A and at the same time forms the one tilting bearing $L_1$ for the crucible 5. To the tilting bearing $L_1$ there is fastened nonrotatably the front, vertical leg **8*a* of a tilting frame 8 whose rear vertical leg 8*b* opens at its upper end into the second tilting bearing $L_2$. The front leg 8*a* and the rear leg 8*b* are fastened together at their lower ends by a tilting platform 8*c***.

The rear tilting bearing $L_2$ is situated at the upper end of a vertical support **9*a* of a chassis 9 which has at its lower portion two parallel, horizontal rails 9*b* and 9*c* (FIG. 4) with bottom surfaces 9*d*. By means of these rails the chassis 9 can roll on a total of six wheels, as it can be seen from an overview of FIGS. 1 and 4. The rails 9b and 9c are joined to one another by cross bars 9e**.

The wheels 10 are stationary on the floor 2a of the vacuum chamber 2, so that the rails 9b and 9c must have an overhang past the rearmost wheel, and to accommodate it an appropriately shaped pocket 2c is disposed in the rear chamber wall 2b. The front ends of the rails 9b and 9c are affixed to the closure plate 4. This closure plate has on its outside 4a, near its bottom edge 4b, additional supporting wheels 11 which run on external rails 12. The supporting wheels 11 can roll with the closure plate 4, so that the entire mobile part of the induction furnace, i.e., the closure plate 4 with the chassis 9, the tilting frame 8 and the crucible 5, will always maintain its stable position, even when the rails 9b and 9c are no longer supported on the rearmost wheels 10.

In FIG. 2 the same parts are provided with the same reference numbers as in FIG. 1. The rotary lead-through 7 has an outer bearing ring 13 in which a hollow cylindrical inner bearing body 14 is supported on rolling bearings not shown and is sealed vacuum-tight by a plate 15 consisting of insulating material with inserted gland packings 16 for the passage of lines 17 to the induction coil 6. By this arrangement a cylindrical cavity 18 is formed within the bearing body 14, in which releasable, water-tight threaded connections 19 are on the lines 17. In the present case the lines 17 are tubes through which coolant flows and which are connected by internal line sections 17a to the induction coil 6 which consists of three individual coils, not represented here, so that by energizing these individual coils with phase-shifted alternating currents a stirring action can be produced in the molten metal.

The external routing and continuation of these combined electrical and water feed lines corresponds quite largely to the state of the art and therefore will not be further discussed. The lines in question are suspended on a boom 20 which is fastened to the closure plate 4.

At its outside front edge the bearing body 14 is provided with a sprocket 21 which is engaged by a tilting drive 22. This tilting drive 22 consists, according to FIG. 3, of a hydraulic cylinder 23 with a piston rod 3a which is connected to a roller chain 24 which is placed on the sprocket 21 of the rotary lead-through 7. The back stroke of the piston rod 23a and the traction force exercised thereby on the chain 24 causes the tilting frame 8 to be tilted about the tilt axis A—A. It can be seen in FIGS. 2 and 3 considered together that the pouring spout 5a and its lip 5b are located in the immediate vicinity of the tilt axis A—A, so that when the pouring is performed, i.e., when the crucible 5 is increasingly tilted, the lip is not subjected to any appreciable relative movement with respect to a mold or flask placed beneath the lip 5b, but not shown here.

Figure 4:
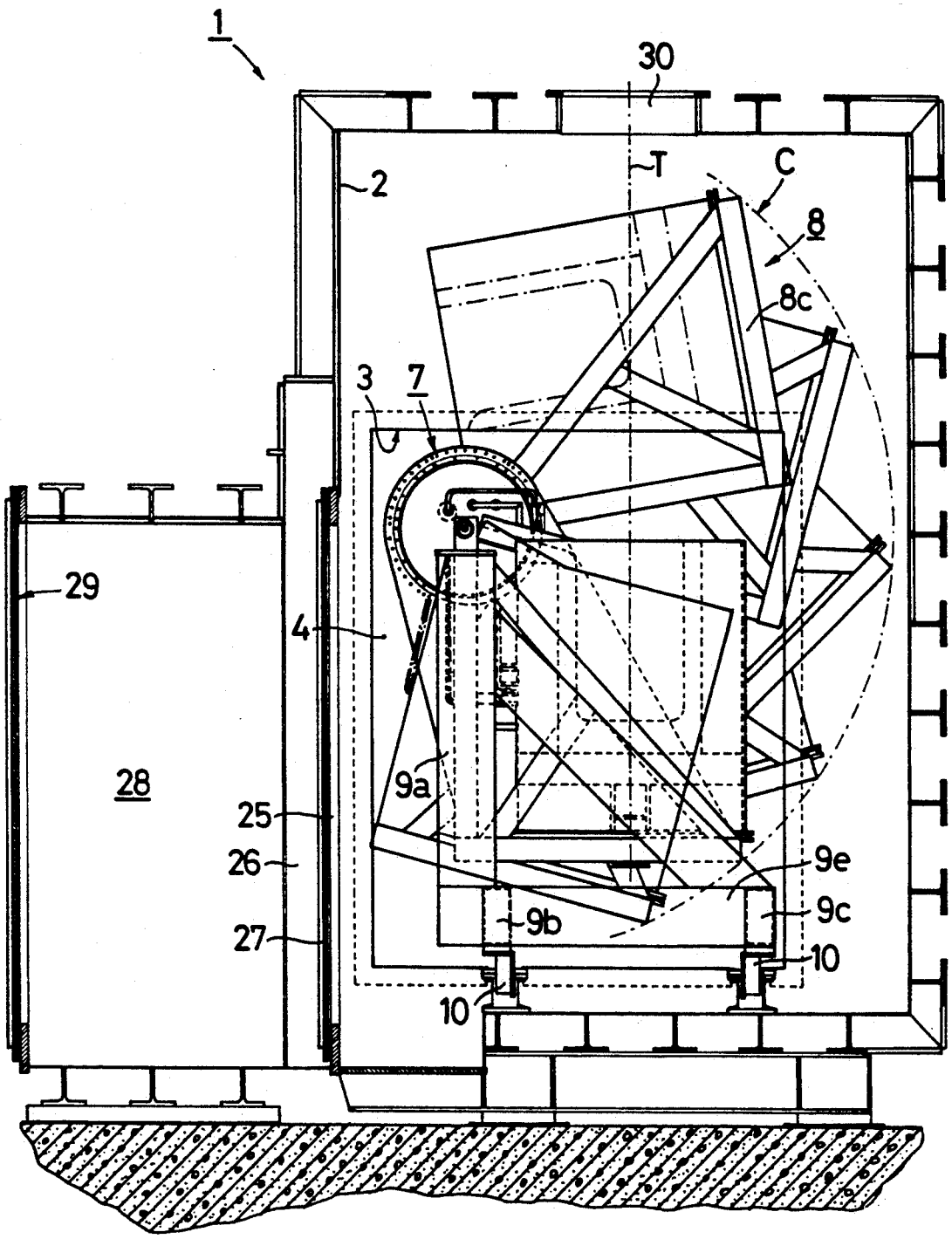
FIG. 4 is a lateral internal view of the complete induction furnace with a stroboscopic representation of the tilting movement of the crucible.

FIG. 4 indicates the movement which the tilting frame 8 performs with the crucible 5 during the pouring. The rear bottom edge of the tilting frame 8 moves on a circular path C about the tilting axis A—A. In the melting position the tilting frame 8 with its platform 8c and the top edge of the crucible 5 are in the horizontal position.

For the performance of slagging operations, the tilting frame 8 can be brought from the melting position to a tilted position in which the rear portion of the crucible margin is lower than the front portion.

Figure 3:
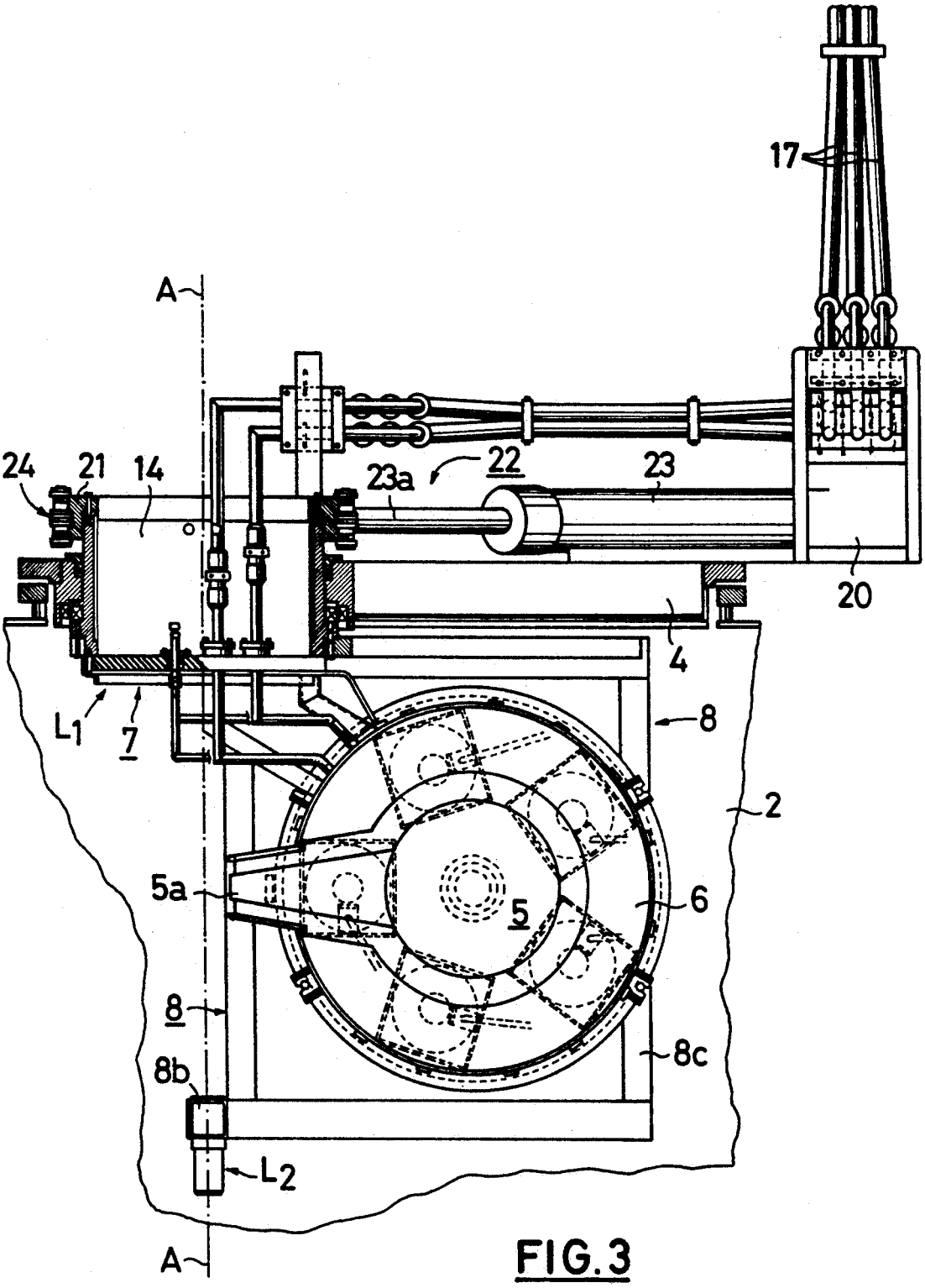
FIG. 3 shows a horizontal section through the complete induction furnace along the tilting axis A—A with a plan view of the crucible with induction coil.

For the purpose of loading the induction furnace 1 with molds or flasks, the furnace chamber 2 has near the position of the pouring spout 5a represented in FIGS. 1 and 3 an additional opening 25 which is in front of a slide pocket 26 with a slide plate 27. See FIG. 4. In front of this slide pocket 26 is a lock chamber 28 which is closed on its outer side by a lock valve 29. By the alternate actuation of the slide plate 27 and the lock valve 29 the induction furnace can be loaded through the lock chamber 28 with molds or flasks which can be brought selectively to an appropriate point below the pouring spout 5a. The closure plate 4 and the lock chamber 28 are situated on two sides of the furnace chamber which are at right angles to one another, as is clearly represented in FIG. 4. For charging the crucible 5 there is situated above the crucible axis T, which is drawn in FIG. 4 for the melting position of the crucible, a charging opening 30 onto which a charging container can be placed which serves as an airlock.

Figure 5:
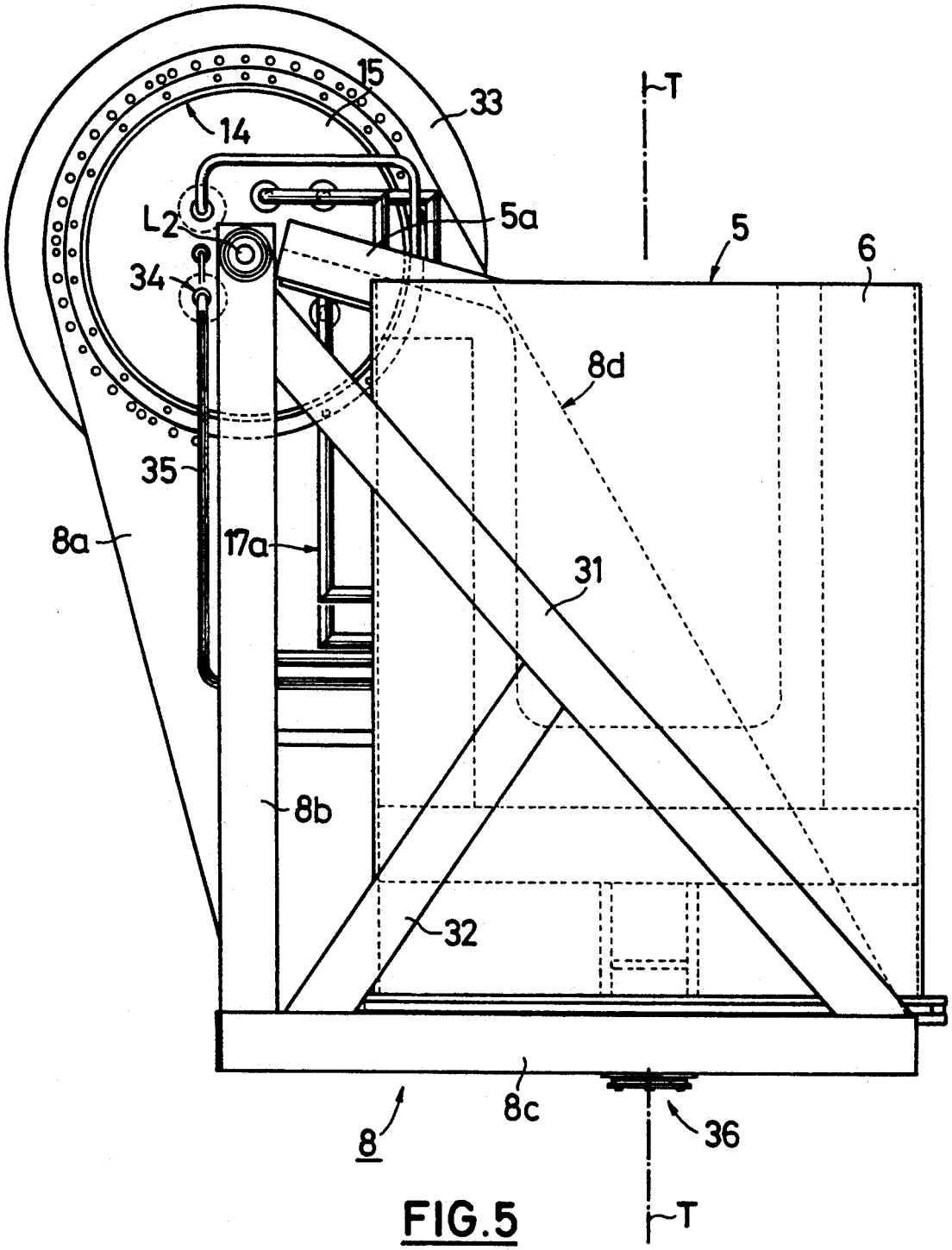
FIG. 5 is a detail of FIG. 4 on a larger scale, to highlight the tilting frame.

In FIG. 5 it can be seen that the front part 8a of the tilting frame 8 consists of a plate whose rear edge 8d reaches to the rear edge of the tilting platform 8c.

In like manner, the upper end of the rear leg 8b of the tilting frame 8 is connected by a strut 31 to the other rear edge of the tilting platform 8c. The strut 31 is joined at the approximate center by another strut 32 to the front part of the tilting platform 8c, so as to assure that the crucible 5 will be completely free of vibration even during the teeming. In the figure a door flange 33 is also represented, to which the bearing ring 13 (here not visible) is joined. In the plate 15 consisting of insulating material there is still another lead-through 34 for a gas line 35 through which the melt can be flooded with argon, for example, in the crucible 5.

In the tilting platform 8c there is a pivot bearing 36 by which the crucible 5 can be rotated about its axis "T." This pivot is in the form of a so-called air film module and permits a lift of up to 22 mm, of which only about 4 millimeters are utilized, anyway, in the pivoting movement.

The subject matter of the invention combines in itself the following advantages:

- No hydraulic connections in the furnace chamber
- Only one water hose in the furnace chamber
- No electric cable in the furnace chamber
- No releasable connections in the furnace chamber
- No driving means in the furnace chamber
- Crucible can be operated both inside the furnace chamber and in the extended position outside of the furnace chamber
- Set-up and take-down as well as maintenance work on the crucible and on the induction coil can be performed outside of the furnace chamber, i.e., no personnel in the furnace chamber
- Crucible can be quickly replaced
- Inspection and cleaning after each melt outside of the furnace chamber without disconnecting lines
- Full furnace power including melting, even outside of the furnace chamber
- Virtually unlimited charge weights
- Tilting forces are not applied to the furnace housing but to the tilting frame
- No application of force to the induction coils.

The foregoing is exemplary and not intended to limit the scope of the claims which follow.

We claim:

1. Induction furnace for melting and casting substances in a non-reactive atmosphere, said furnace comprising a furnace chamber having a floor and a wall with a vertical opening therein, a closure plate associated with said opening so that said chamber is vacuum tight, a chassis to which said closure plate is fixed, said chassis being movable linearly through said opening, a tilting frame borne by said chassis in a pair of tilting bearings which are coaxial to a horizontal tilting axis, and a crucible borne by said tilting frame, said crucible having a pouring spout along said axis between said bearings.

2. Induction furnace as in claim 1 further comprising a pair of horizontal first rails and a plurality of first wheels associated with said rails so that said chassis is movable horizontally with respect to said furnace chamber.

3. Induction furnace as in claim 2 wherein said first rails are fixed with respect to said chassis, said wheels being mounted on said floor.

4. Induction furnace as in claim 3 further comprising a pair of second rials external to said chamber and fixed relative to said floor, and a plurality of second wheels mounted to said chassis.

5. Induction furnace as in claim 1 further comprising an induction coil surrounding said crucible, power lines carrying current for said coil, cooling water lines for said induction coil, and a rotary lead through for said power lines and said cooling water lines, said rotary lead through being incorporated in one of said tilting bearings.

6. Induction furnace as in claim 5 wherein said rotary lead through comprises a hollow cylindrical bearing body having an end facing the crucible and an opposed end, a plate of insulating materials closing said end, gland packings in said plate for bringing said lines through said plate, and a sprocket on said opposed end for engaging a tilting drive.

7. Induction furnace as in claim 1 wherein said crucible is mounted for rotation with respect to said tiling frame about a central vertical axis.

8. Inductive furnace as in claim 7 further comprising an air cushion bearing in said tilting frame, said central vertical axis passing through said air cushion bearing.

9. Inductive furnace as in claim 1 wherein said chassis is movable only in a fixed direction.

10. Induction furnace as in claim 9 wherein said fixed direction is parallel to said horizontal tilting axis.

* * * * *